United States Patent [19]

Gertsch et al.

[11] Patent Number: 4,629,208

[45] Date of Patent: Dec. 16, 1986

[54] SAFETY SKI BINDING

[75] Inventors: Ernst Gertsch, Wengen; Ulrich Gertsch, Matten, both of Switzerland

[73] Assignee: TMC Corporation, Baar/ Zug, Switzerland

[21] Appl. No.: 248,396

[22] Filed: Apr. 28, 1972

[30] Foreign Application Priority Data

May 4, 1971 [CH] Switzerland ..... 6576

[51] Int. Cl.[4] ..... A63C 9/081

[52] U.S. Cl. ..... 280/618

[58] Field of Search ..... 280/11.35 K, 11.35 A, 280/11.35 R, 11.35 T, 11.35 D, 11.35 E, 618

[56] References Cited

U.S. PATENT DOCUMENTS

| | | | |
|---|---|---|---|
| 3,489,424 | 1/1970 | Gertsch et al. | 280/11.35 K |
| 3,606,368 | 9/1971 | Smolka et al. | 280/11.35 D |
| 3,630,538 | 12/1971 | Klein et al. | 280/11.35 T |
| 3,727,933 | 4/1973 | Allsop | 280/11.35 T |
| 3,900,205 | 8/1975 | Sittmann | 280/11.35 K |

FOREIGN PATENT DOCUMENTS

| | | | |
|---|---|---|---|
| 623449 | 6/1961 | Italy | 280/11.35 T |
| 412672 | 11/1966 | Switzerland | 280/11.35 K |

*Primary Examiner*—David M. Mitchell

*Attorney, Agent, or Firm*—Martin A. Farber

[57] ABSTRACT

A safety ski binding embodying a release plate which can be secured to the ski boot, the release plate cooperating at its front and rear with resiliently yielding locking elements rendering possible release of the ski boot and release plate both upwardly and laterally. The release plate is rotatably or pivotably mounted at the ski at a point intermediate the toe and heel of the ski boot heel by means of a pivot bearing enabling raising of the release plate away from the ski. The locking elements oppose lateral release of the release plate either only at the front or at the rear, yet oppose release of the release plate upwardly away from the ski both at the front and rear.

5 Claims, 6 Drawing Figures

SAFETY SKI BINDING

BACKGROUND OF THE INVENTION

The present invention is in the field of skiing and, more specifically, deals with a new and improved construction of safety ski binding for enabling release of the ski boot from the ski during those situations where the skier's leg is subjected to undesired loads where a binding release action is desired.

This particular field of technology is familiar with safety ski bindings incorporating a release or sole plate secured to a ski boot, the release plate cooperating at its front and rear with resiliently yielding locking elements rendering possible a binding release action both in an upward as well as lateral direction. The function of the release plate is to provide favorable constant release conditions, that is, to maintain as low and constant as possible the coefficient of friction between the ski boot sole and the underlying support or ski. By virtue of the constant low coefficient of friction such type ski bindings incorporating a release plate which can be released in all directions not only provide favorable release action for dangerous loads or forces which may arise during a fall of the skier, but also provide such favorable release conditions even in the presence of non-dangerous loads or impacts arising during normal skiing, that these impacts or loads can in fact lead to faulty release of the binding.

Apart from the above it is difficult to adjust the front and rear resiliently biased locking elements and to mutually correlate or adjust the locking element springs such that release of the release plate, notwithstanding the manifold influences arising in all possible combinations during a fall of the skier, will always take place in an optimum manner for the momentarily encountered conditions. This is especially the case if different types of loads, so-called combination or combined loads, for example bending and torsion simultaneously act upon the leg of the skier. Although it is desired, in fact actually required, that in the presence of such loads the lateral release occur with a reduced release moment of rotation, it can happen that the lateral release moment actually increases in the presence of a combined load, for instance owing to shifting of the weight instead of the more favorably located locking element responding the other locking element responds. However, if attempts are made to counter such unfavorable situations by appropriately adjusting the locking elements then it is again possible for faulty binding release to occur. Moreover, there is also to be taken into account the fact that a fine adjustment of the locking spring and therefore also a fine change in the momentary adjustment is difficult to carry out since with a change in the spring force there is not only changed the force with which the locking elements retain the release plate upon the ski, but to a large extent there are also altered the characteristics of the ski binding.

SUMMARY OF THE INVENTION

Hence, it will be recognized from the above discussion that this particular field of technology is still in need of a safety ski binding which is not associated with the aforementioned drawbacks and limitations of the prior art constructions. Accordingly it is a primary object of the present invention to provide a new and improved construction of safety ski binding which effectively and reliably fulfills the existing need in the art and is not associated with the aforementioned limitations of the heretofore proposed safety ski bindings.

Still a further significant object of the present invention relates to a new and improved construction of safety ski binding capable of effectively coping with the aforementioned problems and providing conditions which afford optimum release characteristics for the binding for each expected or non-expected combined load.

Yet a further significant object of the present invention relates to a safety ski binding of relatively simple and economical design, especially suitable for priceworthy fabrication, and which is extremely favorably responsive to loads requiring release of the skier's leg from the binding.

Now in order to implement these and still further objects of the invention, which will become more readily apparent as the description proceeds, the ski binding of this development incorporates a release plate rotatably mounted by means of a pivot bearing at the ski at a location intermediate the toe and heel of the boot, the release plate and pivot bearing coacting with one another in a manner enabling lifting-off of the release plate from the ski. The aforementioned locking elements oppose lateral release of the release plate either only at the front or only at the rear, yet oppose release of such release plate in an upward direction away from the ski both at the front and the rear.

Since the pivot bearing enables lifting of the release plate off of the ski the release plate is not only rotatable but also raisable away from the ski in every rotational position thereof, so that release of such release plate to all sides is possible.

Furthermore, the pivot bearing which is advantageously arranged intermediate the toe and heel of the ski boot, i.e. between the front and rear of the release plate, affords an optimum release angle, so that optimum energy absorption occurs at the release mechanism and the danger of a faulty release action arising is further minimized.

Owing to the provision of the pivot bearing the release plate cannot shift in the lengthwise direction of the ski during normal skiing, and there is thus avoided a further factor possibly oontributing to faulty release action.

Moreover, the presence of the pivot bearing intermediate the toe and heel of the ski boot prevents a too pronounced change in the release value during extreme throughbending of the ski.

Of particular significance, however, is the circumstance that during a fall towards the front or rear the lever arm of the release rotational moment remains unchanged since the release plate can be raised upwardly away from the ski, whereas the lever arm for a lateral or sidewards release rotational moment, in consideration of the presence and location of the pivot bearing, is approximately halved. Consequently, it is possible, without changing the laterally acting release rotational moment, to increase the spring force to about twice the value. However, since a corresponding increase of the release rotational moment during a fall towards the front or rear is not necessary, it is possible for instance to design the inclined surface cooperating with the locking element in this direction so as to be less steep in order to compensate for the increased spring force, the positive action between the locking element and the release plate is thus less effective. As a result, the ski binding has imparted to it a softer characteristic for the same holding force since during partial lifting of the release plate from the ski the spring is only correspondingly slightly compressed together. Hence, the release plate can be raised relatively markedly from the ski until actual release thereof so that it is resiliently retained between this extreme position and its normal position with respect to the ski. Accordingly, during release there does not occur any impact-like loading of the leg or ankle bone. If a combined load occurs then the release plate is more-or-less raised from the ski by the bending load, so that the lateral release is already thus facilitated. In addition the laterally acting positive connection between the locking element and the release plate in relation to raising of the release plate from the ski can be reversible, so that the lateral release rotational moment with regard to the momentary bending load, also in consideration thereof, is inversely proportional.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
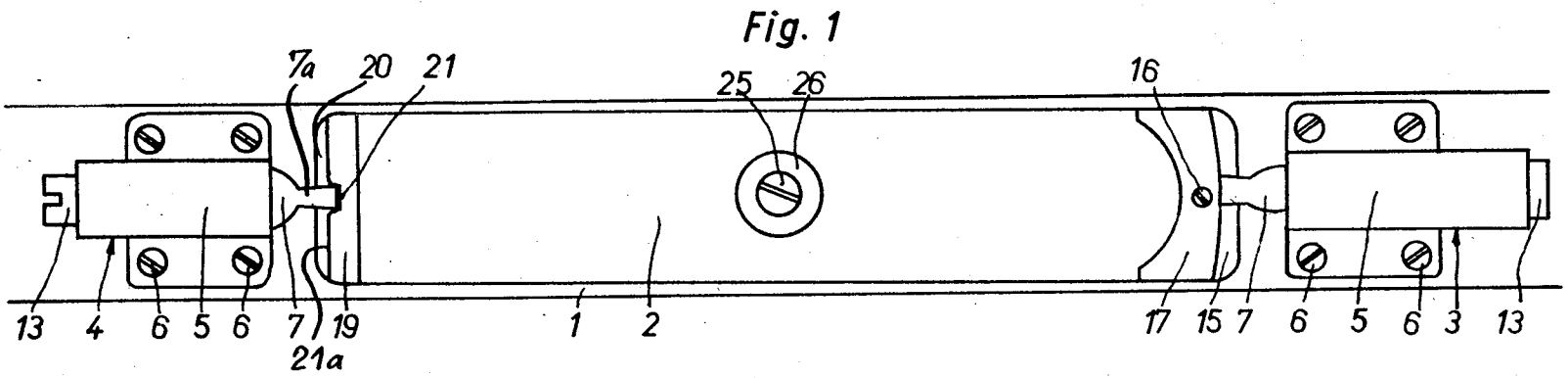
FIG. 1 is a top plan view of a first embodiment of inventive safety ski binding.
Figure 2:
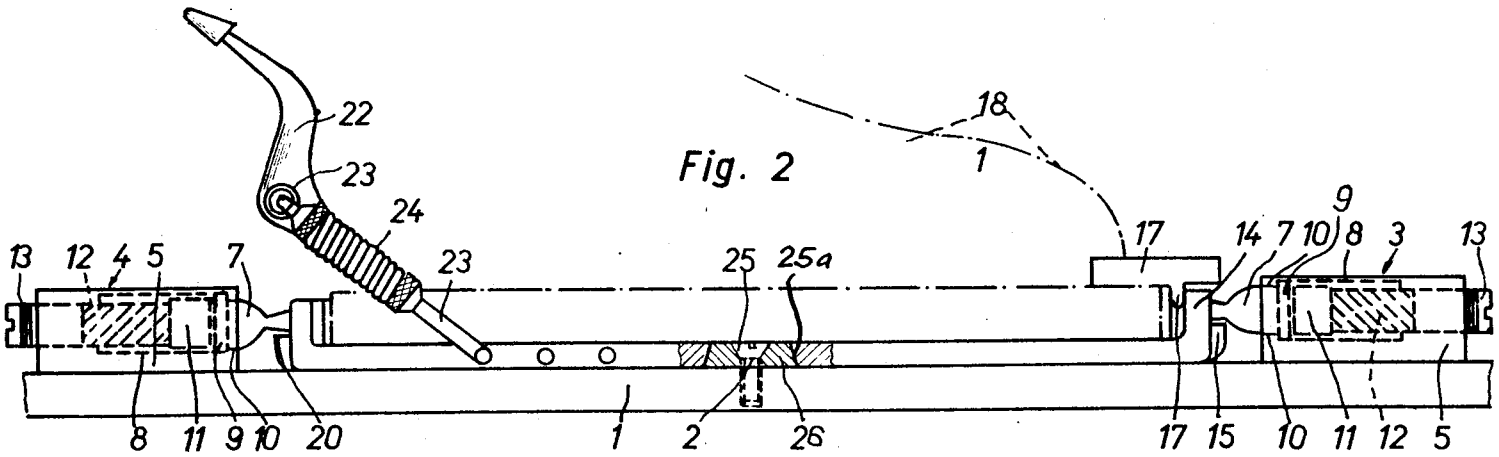
FIG. 2 is a side view of the safety ski binding depicted in FIG. 1.

Describing now the drawings, with the embodiment of safety ski binding depicted in FIGS. 1 and 2 a release plate 2 is secured to the ski 1 by means of two identical locking mechanisms 3 and 4. The housing 5 of each such locking mechamism 3 and 4 is secured to the ski 1 by means of screws 6 or equivalent fastening expedients, and in each such housing 5 there is mounted a locking pin 7 in a cylindrical bore 8 of such housing. The pin member 7 possesses a substantially circular-shaped shoulder 9 which engages behind an inner flange 10. A piston 11 is slidably arranged in the bore 8, the associated locking pin 7 bearing against the piston 11 at one face thereof and against the other face of the piston 11 there bears a pressure spring 12. This pressure spring 12 is supported against an adjustment screw 13 threadably connected into the associated housing 5. Adjustment screw 13 serves for adjusting the pressure of the spring 12. Locking mechanisms of this general type are known to the art from our U.S. Pat. No. 3,489,424, granted Jan. 13, 1970, and entitled "Safety Ski Binding".

Further, it will be seen that the release plate 2 is provided at its front end with an upstanding edge 14 at which there is formed an arc-shaped support surface 15 with which cooperates the front locking pin 7. At this upstanding edge 14 there is secured by means of a screw 16 a sole holder or holddown mechanism 17, through the action of which the ski boot 18 shown in phantom lines is fixedly held at its front region against the release plate 2. At the rear end of the release plate 2 there is also provided an upstanding edge 19 at which there is formed a support surface 20 for the rear locking pin 7 and a central recess 21 with which engages such rear locking pin 7. The ski boot 18 is fixedly retained against the release plate 2 at its rear region by means of a conventional clamping lever 22 which in its stressed or loaded condition acts upon the sole of the ski boot 18. This clamping lever 22 is hingedly connected in a manner known from the aforementioned U.S. Pat. No. 3,489,424 with the release plate 2 through the agency of connection elements 23 and tension springs 24.

At the ski 1 there is connected by means of a screw 25 or equivalent fastening device a substantially circular-shaped bearing or pivot disc 26. The release plate 2 has a slightly conically formed bore **25*a* at its central region, the diameter of which corresponds to the diameter of the bearing or pivot disc 26. In this way the bearing disc 26 forms a pivot bearing for the release plate 2**.

As should be apparent during a sidewards or lateral release action the release plate 2 is rotated about the pivot bearing and the axis of the bearing disc 26. As a result the rear locking pin 7 is rocked, departs from the recess 21 and travels along the laterally merging contact or run-on surfaces **21*a* and thus exerts a counter rotational force upon the release plate 2, whereas the front locking pin 7 does not produce any opposing resistance against rotation of the release plate 2. During a fall of the skier towards the front the support surface 20 rocks the rear locking pin 7 upwards or towards the top and thereby brings about the requisite release action of the binding, whereas during a fall of the skier towards the rear the support surface 15 rocks the front release pin 7** upwardly and again initiates the release action of the binding.

During lateral release the release plate 2 and its recess 21 engages directly at the end **7*a* of the protruding pin of the locking element 7. The point of attack of the support surface 20 is, however, located somewhat further towards the rear. In order to bring about a rocking or pivoting of the locking element 7 through a certain angle there is required a larger upward force than towards the one or the other side. Such an arrangement corresponds to the requirement of having a greater release rotational moment in the vertical direction than in the lateral direction. Now by virtue of the use of the bearing or pivot disc 26 the lever arm for the lateral release rotational moment is approximately halved not however the lever arm for the vertical release rotational moment, and thus it is possible for the force of the spring 12 to be increased to about twice. To the same degree it is possible to displace the rear (effective) edge of the support surface 20 towards the front. As a result, however, the length of the locking element 7 effective in the vertical direction becomes greater and accordingly the locking element 7 during raising of the rear end of the release plate 2 from the ski is always rocked through a smaller angle. The associated spring 12 is thus compressed together to a correspondingly less extent. Hence the ski binding has imparted to it a softer characteristic and the release plate 2** is resiliently retained between its normal position at the ski and the position in which the release action occurs.

Figure 3:
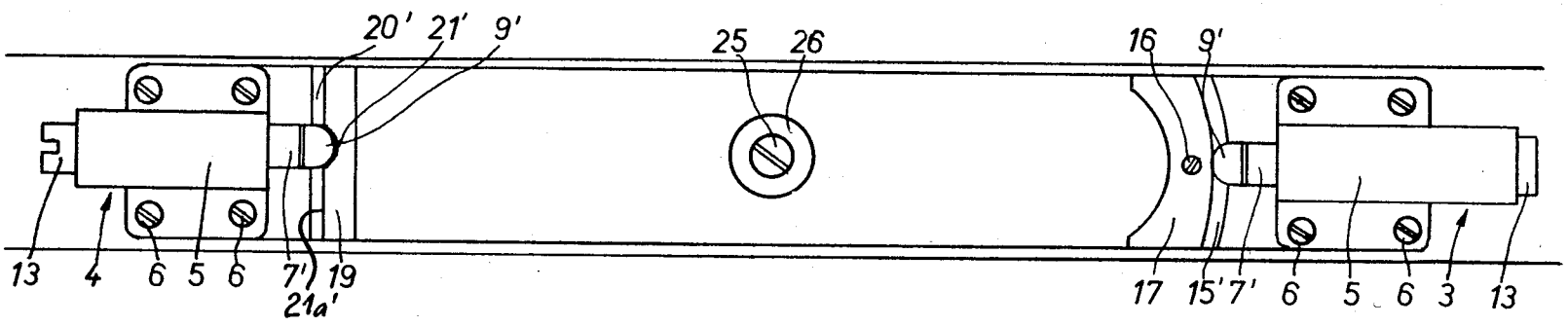
FIG. 3 is a top plan view of a second embodiment of safety ski binding.
Figure 4:
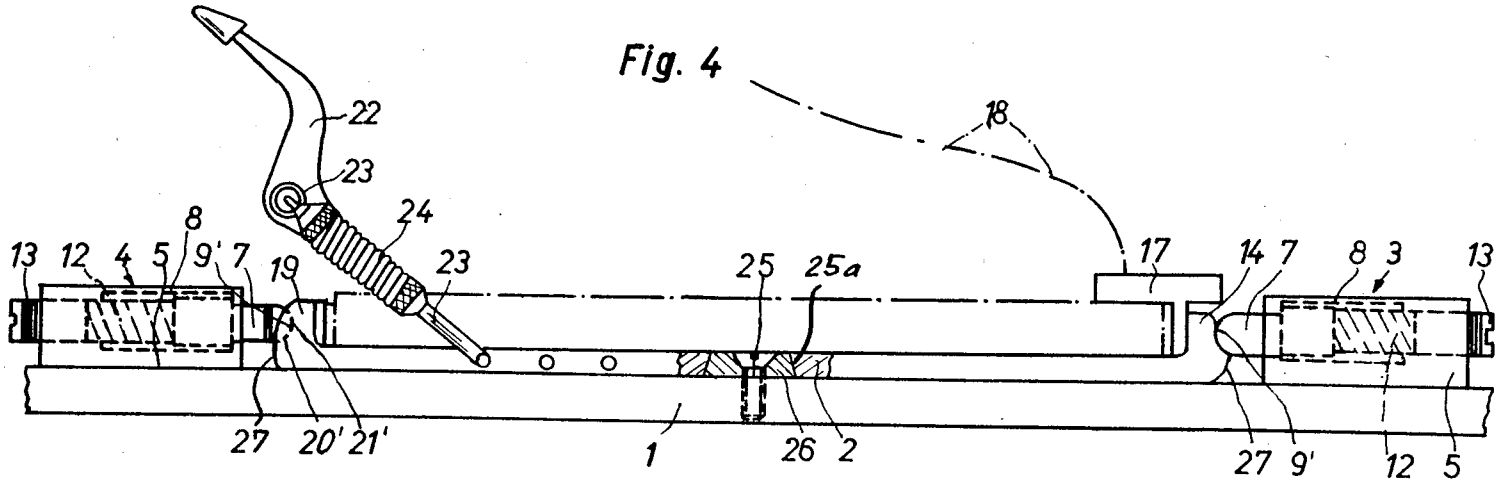
FIG. 4 is a side view of the safety ski binding depicted in FIG. 3.

Considering now the embodiment of safety ski binding as depicted in FIGS. 3 and 4 such differs from the embodiment of FIGS. 1 and 2 primarily in the features that in the bore 8 of each housing 5, instead of there being provided a pivotable locking pin 7, there is provided an axially displaceable locking pin 7' having a hemispherical-shaped terminal portion 9'. The pressure spring 12 acts against this locking pin 7'. The terminal portion 9' of the front locking pin 7' cooperates with an appropriate support surface 15 of the upstanding edge 14 of the release plate 2 and the terminal portion 9' of the rear locking pin 7' cooperates with a support surface 20' and a recess 21' of the upstanding edge 19 of the release plate 2. If for this embodiment of safety ski binding during a lateral release action the release plate 2 is rotated about the pivot bearing and the axis of the bearing disc 26, then, the rear locking pin 7' is displaced back against the action of the spring and escapes out of the recess 21' and travels upon the laterally merging contact or impact surfaces 21a', so that it exerts a counter rotary force against the release plate 2. On the other hand, the front locking pin 7' does not exert any resistance during rotation of the release plate 2. During a fall of the skier towards the front the support surface 20' pushes back the rear locking pin 7' and brings about the release action. During a fall towards the rear the support surface 15' pushes back the front locking pin 7', and brings about the release action.

Also in this case the effective rear edge of the support surface 20' can be displaced further towards the front in accordance with the increase in the force of the spring 12, so that there is realized a softer characteristic of the ski binding. The observations heretofore made in conjunction with the discussion of the first embodiment of the invention as considered with regard to FIGS. 1 and 2 are also analogously applicable in this case. It is possible to recognize particularly clearly on the basis of FIGS. 3 and 4 that the lateral release rotational moment is reduced during lifting of the rear end of the release plate from the ski. An appropriate configuration of the counter surfaces of the release plate cooperating with the locking element in this case offers a multiplicity of possibilities for influencing the action of the binding. Generally, however, the soft characteristic of the ski binding is favorable for the use of these possibilities since in this way there is rendered possible a more-or-less pronounced lifting-off of the release plate from the ski without the release action occurring in a sudden or jolting manner, as would be the case if the binding had a hard release characteristic.

The lower bevelled surfaces 27 appearing at both ends of the release plate in this embodiment serve for engageably connecting or latching the release plate 2 at the ski.

Figure 5:
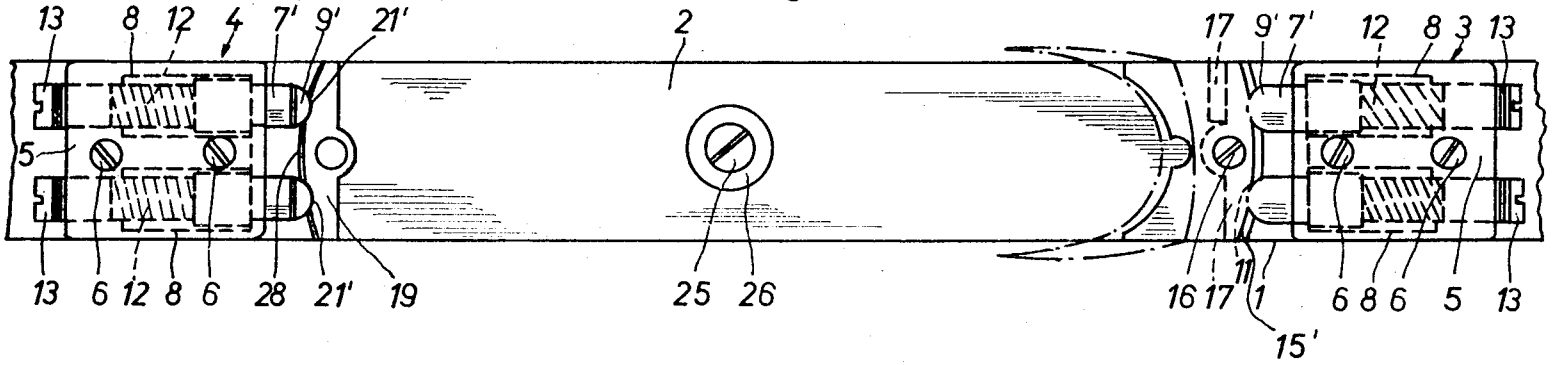
FIG. 5 is a top plan view of a third embodiment of safety ski binding.
Figure 6:
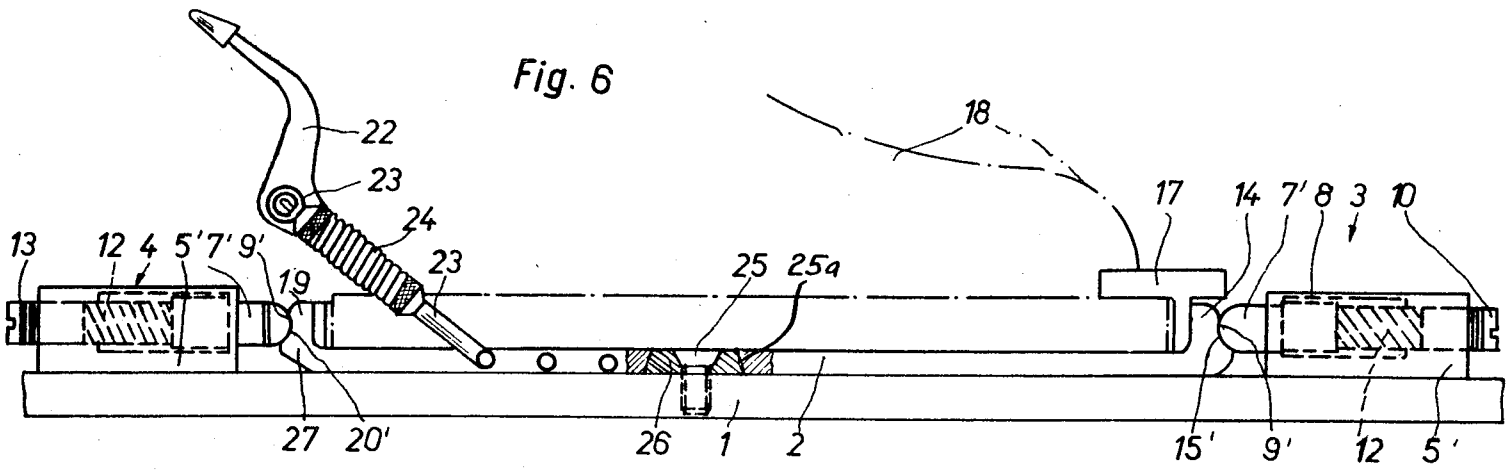
FIG. 6 is a side view of the safety ski binding depicted in FIG. 5.

Now with the embodiment of safety ski binding depicted in FIGS. 5 and 6, instead of there cooperating with each end of the release plate 2 a respective single locking pin, here two respective locking pins 7' cooperate with each such end of the release plate. These dual locking pins 7' are arranged adjacent one another in a common housing 5', and specifically are arranged in bores 8 so as to be axially displaceable and can be acted upon by the pressure springs 12 which are individually adjustable by a respective adjusting screw 13. The hemispherical-shaped terminal portion 9' of each of both front locking pins 7' cooperate with a support surface 15' of the upstanding edge 14 of the release plate 2. The hemispherical-shaped terminal portion 9' of each of both rear locking pins 7' cooperate with a support surface 20' and with a respective recess 21' of the associated upstanding edge 19 of the release plate 2. Between both recesses 21' there is present at the upright edge 19 a contact or run-on surface 28. If with this embodiment of ski binding during a lateral release action the release plate 2 is rotated about the pivot bearing or the axis of the bearing disc 26, then, depending upon the direction of rotation the one or the other of both rear locking pins 7' will be retracted or pushed back and departs from its associated recess 21' and slides over the contact or run-on surface 28, whereas the other rear locking pin will not be pushed back. Both of the front locking pins 7' are also not pushed back and they do not offer any resistance to rotation of the release plate 2. During a fall by the skier towards the front the support surface 20' displaces both rear locking pins 7' back and brings about the binding release action and during a fall towards the rear the support surface 15' displaces back both of the front locking pins 7' and brings about the release action. Hence with this embodiment of ski binding during a lateral release action only one of the locking pins is effective, during a release action towards the top, that is away from the ski, two locking pins are effective. Advantageously, for the purpose of accommodating the ski binding to different loads the locking pins 7' can be differently adjusted, that is each locking pin can be subjected to a different biasing force by means of the adjusting screws 13.

In all of the embodiments of this invention of ski binding the rear locking element or elements participates in the lateral release action. As a result, it is possible to adjust the retaining or holding force exerted by the front locking element solely in consideration of a rearward fall. As a result, it is however possible to accommodate the binding not only to the individual conditions or factors pertaining to a given skier, as such is otherwise conventional, thus also to his skiing technique, but moreover with regard to the construction of the ski boot which is used. The height of the boot upper plays a much more important role during a fall of the skier towards the rear than towards the front, firstly because in the last-mentioned case the muscle strength is more capable of opposing the fall. Accordingly, attempts are oftentimes made to construct the ski boot, for instance by extending the upper, such that during a fall of the skier towards the rear there is exerted an increased support action. The independent adjustment possibility of the holding force of the front locking element now renders it possible to carry out the adjustment individually to such a great extent, that, for instance, in the case of two equal size, equal weight and equal skiing style skiers, the front release action is accommodated to the momentarily worn ski boots. On the other hand, the same person can use completely different ski boots since the binding can be readily appropriately adjusted. Consequently, the safety of the skier is considerably increased and there is dispensed with the requirement of preferring certain types of ski boots.

Moreover, during a fall of the skier towards the rear there is realized an additional increase in the skier's safety if the height of the bearing or pivot disc is chosen such that during a backwards or rearward fall, yet however prior to release of the release plate by the front locking element, such bearing disc at least partially departs from the associated suitably formed recess of the release plate. In this case, then, if there simultaneously occurs a torsion load, the release plate can rock towards the side, whereby if necessary it travels with the edge of its central opening upon the upper edge of the bearing disc and is dispaced by such upwardly. Consequently, in the extreme situation there is realized a compensation for the fact that during a rearward fall the rear portion of the release plate will be pressed more intensely against the ski. Also here measures have been provided which ensure that upon the occurrence of a combined load the lateral release action is rendered easier in order to effectively counter the danger of complicated bone fractures.

While there is shown and described present preferred embodiments of the invention, it is to be distinctly understood that the invention is not limited thereto but may be otherwise variously embodied and practiced within the scope of the following claims. ACCORDINGLY,

What is claimed is:

1. A safety ski binding for a ski, comprising a release plate having front and rear end regions and capable of being connected with the ski boot, resiliently yielding locking element means cooperating with the front and rear end regions of the release plate and rendering possible release of the release plate from the ski both upwards as well as laterally, pivot bearing means for rotatably mounting the release plate between its front and rear intermediate the toe and heel of the ski boot at the ski and enabling raising of the release plate from the ski, said locking element means and release plate having cooperating means enabling said locking element means to oppose lateral release of the release plate either only at the front or only at the rear, yet opposing upward release of the release plate both at the front and at the rear, said resiliently yielding locking element means which opposes lateral and upward release of the release plate having a common setting means for providing the same resilient setting for such associated resiliently yielding locking means, so that for a given setting of said common setting means there are effective different moments which respectively oppose the vertical release action and the lateral release action, said locking element means cooperating with the front and rear end of the release plate possesses a respective locking pin defining the cooperating means of said locking element means, and means for mounting each such pin to be pivotable to all sides.

2. A safety ski binding for a ski, comprising a release plate having front and rear end regions and capable of being connected with the ski boot, resiliently yielding locking element means cooperating with the front and rear end regions of the release plate and rendering possible release of the release plate from the ski both upwards as well as laterally, pivot bearing means for rotatably mounting the release plate between its front and rear intermediate the toe and heel of the ski boot at the ski and enabling raising of the release plate from the ski, said locking element means and release plate having cooperating means enabling said locking element means to oppose lateral release of the release plate either only at the front or only at the rear, yet opposing upward release of the release plate both at the front and at the rear, said resiliently yielding locking element means which opposes lateral and upward release of the release plate having a common setting means for providing the same resilient setting for such associated resiliently yielding locking means, so that for a given setting of said common setting means there are effective different moments which respectively oppose the vertical release action and the lateral release action, each locking element means cooperating with the front and rear end regions of the release plate comprises a respective locking pin defining the cooperating means of said locking element means, and means mounting each such pin so as to be axially displaceable against the action of a spring.

3. A safety ski binding for a ski, comprising a release plate having front and rear end regions and capable of being connected with the ski boot, resiliently yielding locking element means cooperating with the front and rear end regions of the release plate and rendering possible release of the release plate from the ski both upwards as well as laterally, pivot bearing means for rotatably mounting the release plate between its front and rear intermediate the toe and heel of the ski boot at the ski and enabling raising of the release plate from the ski, said locking element means and release plate having cooperating means enabling said locking element means to oppose lateral release of the release plate either only at the front or only at the rear, yet opposing upward release of the release plate both at the front and at the rear, said resiliently yielding locking element means which opposes lateral and upward release of the release plate having a common setting means for providing the same resilient setting for such associated resiliently yielding locking means, so that for a given setting of said common setting means there are effective different moments which respectively oppose the vertical release action and the lateral release action, each locking element means comprises two locking elements cooperating with the front end region and two locking elements cooperating with the rear end region of the release plate.

4. The safety ski binding as defined in claim 3, further including a common housing for each two locking elements, both respective locking elements being arranged adjacent one another in their associated common housing.

5. A safety ski binding for a ski, comprising a release plate having front and rear end regions and capable of being connected with the ski boot, resiliently yielding locking element means cooperating with the front and rear end regions of the release plate and rendering possible release of the release plate from the ski both upwards as well as laterally, pivot bearing means for rotatably mounting the release plate between its front and rear intermediate the toe and heel of the ski boot at the ski and enabling raising of the release plate from the ski, said locking element means and release plate having cooperating means enabling said locking element means to oppose lateral release of the release plate either only at the front or only at the rear, yet opposing upward release of the release plate both at the front and at the rear, each locking element means comprising two locking elements cooperating with the front end region and two locking elements cooperating with the rear end region of the release plate, and wherein during release of the release plate laterally only one of the locking elements of the locking element means opposing lateral release is effective and during release of the release plate upwards both locking elements of said locking element means are effective.

* * * * *